United States Patent [19]

Dieval

[11] Patent Number: 4,777,882

[45] Date of Patent: Oct. 18, 1988

[54] PROJECTILE CONTAINING SUB-MUNITIONS WITH CONTROLLED DIRECTIONAL RELEASE

[75] Inventor: Gérard Dieval, Neuilly, France

[73] Assignee: Thomson-Brandt Armements, Boulogne Billancourt, France

[21] Appl. No.: 70,979

[22] Filed: Jul. 8, 1987

[30] Foreign Application Priority Data

Oct. 31, 1986 [FR] France ..... 86 15236

[51] Int. Cl.[4] ..... F42B 13/50

[52] U.S. Cl. ..... 102/489; 102/357; 102/506; 102/703; 102/393

[58] Field of Search ..... 102/340, 342, 351, 357, 102/455, 457, 489, 505, 703, 506, 393

[56] References Cited

U.S. PATENT DOCUMENTS

| | | | |
|---|---|---|---|
| 1,340,871 | 5/1920 | Barker et al. . | |
| 2,809,583 | 10/1957 | Ortynsky et al. . | |
| 3,088,404 | 5/1963 | Brown et al. . | |
| 3,599,568 | 8/1971 | Shellnutt | 102/455 |
| 3,673,047 | 6/1972 | Buth et al. | 102/438 |
| 3,881,416 | 5/1975 | Dilworth Jr. | 102/703 |
| 3,903,804 | 9/1975 | Luttrell et al. | 102/703 |
| 4,430,941 | 2/1984 | Raech, Jr. et al. . | |

FOREIGN PATENT DOCUMENTS

| | | | |
|---|---|---|---|
| 199368 | 12/1906 | Fed. Rep. of Germany . | |
| 314680 | 9/1916 | Fed. Rep. of Germany | 102/506 |
| 621608 | 5/1927 | France . | |

*Primary Examiner*—Harold J. Tudor

*Attorney, Agent, or Firm*—Marmorek, Guttman & Rubenstein

[57] ABSTRACT

A projectile forming the head of a carrier has a defined balllistic trajectory and contains sub-munitions ejected, at a given moment in the trajectory of the projectile, in a controlled direction. In the projectile, the sub-munitions are arranged so as to have a single direction, namely with the head of the sub-munition facing the front of the projectile, in one or more rows. In each row, the shells of the sub-munitions are tangential to one another and their fin systems ar placed in one another in a self-locking way. The projectile further comprises securing means among the sub-munitions and between these interstitial spaces are further filled with a powdery material.

8 Claims, 2 Drawing Sheets

PROJECTILE CONTAINING SUB-MUNITIONS WITH CONTROLLED DIRECTIONAL RELEASE

BACKGROUND OF THE INVENTION

1. Field of the Invention

The present invention relates to a projectile forming the head of a carrier, such as a bomb, missile etc., a carrier of this type being possibly provided with a propulsion device and a system of fins or a guidance system so that it has a defined ballistic trajectory.

More precisely, the present invention relates to a projectile containing sub-munitions which are released, in a controlled direction, at a given moment on the trajectory of the carrier.

2. Description of the Prior Art

Modern weapons systems very often use the concept of a projectile that itself carries sub-munitions (or sub-charges) which have to be distributed over large areas or volumes. In the systems of the prior art, no special precautions are usually taken to arrange the sub-munitions inside the projectile. This results in the random distribution and direction of the sub-munitions when released or, at least, in a substantial loss of precision in their speed and direction. As a result only a portion, sometimes a small portion, of the sub-munitions reaches the objective while the remainder are lost.

An object of the present invention is to enable the release of sub-munitions in a preferred direction, with adequate control over the direction in which they are pointed, so that their subsequent ballistic behavior is not disturbed.

3. Summary of the Invention

More precisely, an object of the invention is a projectile containing sub-munitions, each having a fixed fin system, for example with three fins. The sub-munitions are arranged so that they are pointed in a single direction (with the head forward and fin system towards the rear of the main projectile) in one or more rows. In each row, the shells of the sub-munitions are tangential with one another, and the fin systems being placed in one another in a self-locking way. The projectile further has securing elements between the shell of the main projectile and the structure formed by the sub-munitions. In an alternative embodiment, the projectile comprises additional securing means arranged between the various sub-munitions of one and the same row. Finally, the spaces that remain unoccupied between the sub-munitions and the securing elements are filled with a powdery substance designed to increase the rigidity of the assembly and, when the projectile has several rows of sub-munitions, to ensure and maintain a gap between the rows.

BRIEF DESCRIPTION OF THE DRAWINGS

Other objects, specific features and results of the invention will be seen from the following description, illustrated by the appended drawings of which.

In these different figures, the same references pertain to the same elements.

DESCRIPTION OF THE PREFERRED EMBODIMENT OF THE INVENTION

Figure 1:
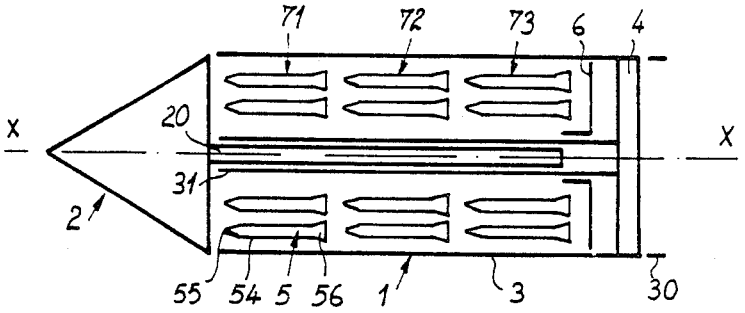
FIG. 1 shows an embodiment of the projectile according to the invention.
Figure 3A:
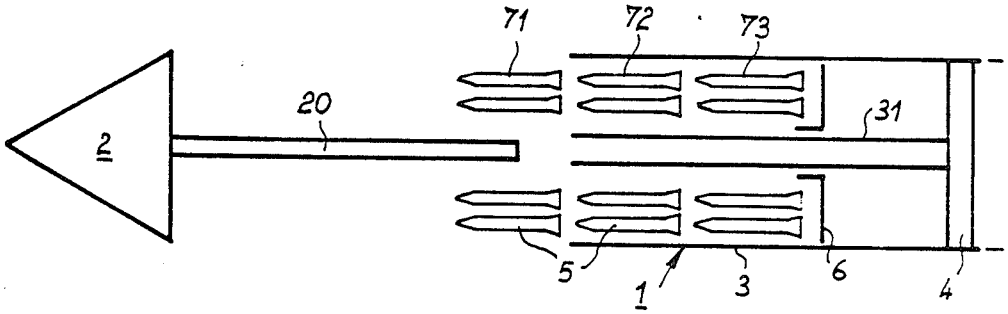
FIGS. 3*a* and 3*b* show two stages in the release of the sub-munitions from the projectile of the invention.
Figure 3B:
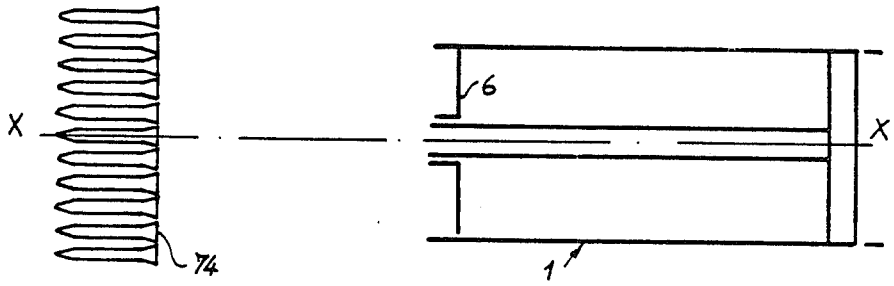

FIG. 1 shows a schematic longitudinal section view of a projectile according to the invention.

This projectile, with a longitudinal axis XX, bears the general reference 1 and has a cylindrical casing 3 which ends, on one side, in the nose 2 which has an aerodynamic (for example, substantially conical) shape. At the other end, the projectile is fixed to the rest of the carrier, shown in dotted lines 30.

Sub-munitions 5 are arranged longitudinally inside the casing 3. Each of them has a cylindrical shell 54 which ends in front with an aerodynamic (for example, substantially conical) head 55 and, on the other side, with a fin system 56 so that it can remain pointed in a given direction on a given path. The sub-munitions 5 are arranged in the projectile in one or (as in the example of FIG. 1) several rows marked 71, 72 and 73. They are arranged here so as to be pointed in a single direction, i.e. their head 55 is pointed towards the front of the projectile.

The sub-munitions may be explosive ammunition, counter-measures (infrared or illumination) ammunition, decoy or kinetic energy ammunition.

Figure 2:
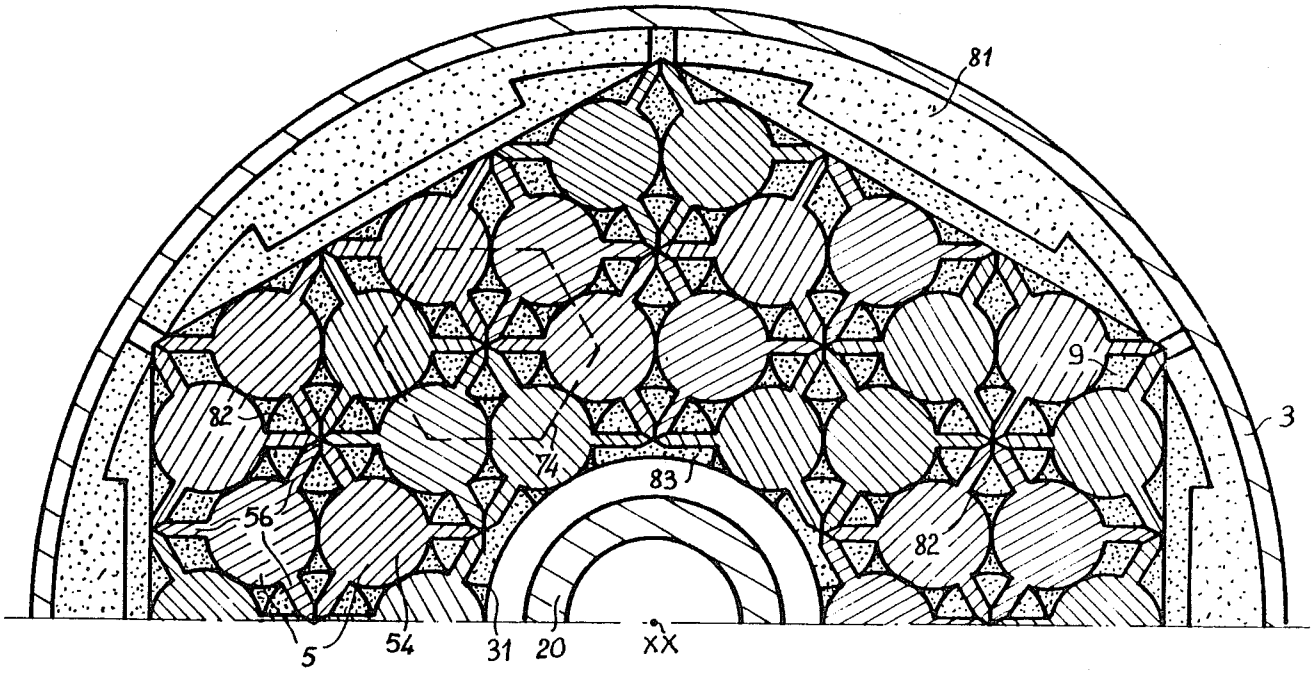
FIG. 2 is a cross-sectional view of an embodiment of the projectile according to the invention.

One embodiment of a method to arrange the sub-munitions 5 inside the projectile 1 is given in FIG. 2, which is a cross-section view of half of the projectile 1 of FIG. 1 at the fin system of the sub-munitions of one of the rows 71, 72, or 73.

This cross-section view shows the external casing 3 and, towards the center, a shaft 20 supporting the nose 2 and an inner casing 31. The shaft 20 of the nose can be moved in the casing 31 to enable the ejection of the nose as described further below. All the sub-munitions 5 are arranged between the casings 3 and 31. The figure also shows the shell 54 of each of the sub-munitions 5 and their fin systems 56, the elements 54 and 56 being shown with hachured lines to make the drawing clearer. In this embodiment, the fin system of each sub-munition 5 comprises three fins set at 120° to one another. The shells 54 of the sub-munitions are arranged in a hexagon, one example of which is shown in dotted lines 74, the center of the shells 54 forming the vertices of the hexagon and the shells 54 being tangential with one another. The fins are set inside one another in such a way that the structure formed by all the sub-munitions is self-locking, i.e. at the center of the hexagon 74, there are six fins respectively belonging to the six sub-munitions 5 of the hexagon, locked into one another.

In a preferred embodiment of the invention, internal securing elements 82 are arranged between the sub-munitions 5, around the shell 54. These elements 82 are, for example, shaped substantially like cylinders and extend along the entire length of the shell 54 or along only a part of it. For the clarity of the FIG. 2, the surfaces of the elements 82 are dotted. The function of these internal securing elements 82 is to improve the rigidity of all the sub-munitions 5, especially when the projectile is driven by a rotational motion on its longitudinal axis. In a preferred embodiment, the securing elements 82 are made of a flexible material such as plastic foam, pre-stressed so as to compensate for any gaps in the structure. Between the sub-munitions 5 and the inner casing 31, truncated securing elements, marked 83, may be positioned to increase the rigidity of the structure.

Between the structure formed by all the sub-munitions 5 and the external casing 3, there are also securing elements marked 81, the purpose of which is to prevent the sub-munitions 5 from being moved outwards, off direction. These elements 81 have a shape adapted to the unoccupied space between the structure formed by the sub-munitions and the external casing 3. They do not obligatorily have a constant cross-section, as shown in FIG. 2. However, in a preferred embodiment, they are in contact with the casing 3 and the sub-munitions 5. They are made, for example, of a plastic material and are preferably made of a relatively rigid material capable of splitting up when the sub-munitions are ejected, according to a mechanism described below, so that this ejection process is not disturbed.

Finally, the spaces left unoccupied between the walls 31 and 3 by the sub-munitions 5 and the securing elements 81, 82 or 83 are filled with a powdery material 9, the function of which is firstly to provide for better immobilization of the sub-munitions 5 in the casing 3 and, secondly, to secure that the rows 71, 72 and 73 are separated (see FIG. 1) for a reason related to the ejection of the sub-munitions, as explained below. This powder 9 can also be used to display the releasing point of the sub-munitions, thus making it easier to use.

The projectile 1 (FIG. 1) further has a disk 6 that encloses the space between the casings 3 and 31 behind the loading space of the sub-munitions, actuated by propulsion means 4 when the sub-munitions are released.

FIGS. *3a* and *3b* are diagrams illustrating the mechanism for ejecting the sub-munitions from the main projectile 1.

In a first stage, under the effect of the propulsion means 4 shown schematically behind the projectile 1, the shaft 20 of the nose 2 slides inside the casing 31 until the said nose is separated from the projectile. The nose is designed so that it then remains stable and does not disturb the movement of the sub-munitions while they are being ejected or that of the main projectile.

In a second stage, the propelling means 4 give the disk 6 a relatively forward movement with respect to the casing 3, leading to the successive ejection of the rows 71, 72 and 73 of the sub-munitions 5. During the ejection of all the rows 71 to 73, the securing elements 81 to 83 and the powdery material 9 are separated from the sub-munitions as and when the said sub-munitions appear at the edge of the casing 3.

FIG. *3a* shows the moment when the nose 2 is entirely ejected from the casing 3 and when the first of the rows, namely the row 71, is also entirely ejected.

As is known, on leaving the casing 3, each sub-munition 5 has a relative longitudinal velocity as well as a radial velocity also known as the expansion velocity, caused by the aerodynamic force exerted on it upon leaving the casing 3 and, as the case may be, upon the rotation of the main projectile. Furthermore, each row, upon making its exit, is slowed down by this aerodynamic force. The two phenomena in combination give an interpenetration between the various rows as shown in FIG. *3b* where, since the three rows are all ejected, the various sub-munitions 5 are substantially on the same line 74 where they form a single garland driven by a longitudinal velocity and a radial expansion velocity. It must be noted that the expansion velocity depends on the rotational speed of the projectile 1, the sizing of the securing elements and the geometrical characteristics of the sub-munitions and their position with respect to the longitudinal axis (XX) of the projectile. The experiments and calculations of the applicant have show that it is then important for the heads of the sub-munitions of one row to have no mechanical contact with the rear of the sub-munitions of the previous row, so as to prevent a rear sub-munition from disturbing and pushing the sub-munition in front off direction. Furthermore, the gap between the rows should be sufficient for the rows to be interpenetrated properly, without any contact (or at least with a minimum degree of contact) between sub-munitions. This separating function is fulfilled, as explained above, by the powdery material 9.

Thus, according to the invention, the sub-munitions are held rigidly in position before ejection so that, at the moment of ejection, they are capable of following the planned trajectory. Furthermore, means are provided so that, during this ejection, the path of each sub-munition is disturbed neither by the various constituent elements of the projectile nor by the other sub-munitions.

The above description has been given as a non-exhaustive example. Thus, the main projectile has been described as having a cylindrical shell with a circular cross-section, but this cross-section can have other shapes. For example, it could be square-shaped, in which case the sub-munitions would have four fins. More generally, other geometrical shapes can be used for the shell of the projectile, the shell and fin system of the sub-munitions and their organization (in a hexagon in FIG. 2) provided that the shells of the sub-munitions are tangential with one another and that their fin systems are organized in a self-locking way.

What is claimed is:

1. A projectile comprising:

an external shell having a front end and a rear end, a plurality of sub-munitions, each sub-munition comprising a shell provided with a head at a front end thereof and a fixed fin system at a rear end thereof, said sub-munitions being arranged in rows within said external shell, within each row adjacent sub-munitions are positioned tangential to one another and so that the fin system of each sub-munition interlocks with the fin systems of adjacent sub-munitions, all of said sub-munitions being oriented in a single direction parallel to a longitudinal axis of said external shell and with said heads of said sub-munitions facing towards the front end of said external shell, securing elements positioned between said external shell and the arrangement of said sub-munitions, means associated with said external shell for ejecting said sub-munitions through said front end of said external shell, and a powdery substance for maintaining gaps between said rows of sub-munitions to prevent the front ends of the sub-munitions in one row from disturbing the rear ends of the sub-munitions in an adjacent row, wherein said gap is such that when the sub-munitions are ejected, the various rows interpenetrate one another without any substantial mutual disturbance in the paths of the sub-munitions.

2. A projectile according to claim 1, wherein the fin system of the sub-munitions comprises three fins.

3. A projectile according to the claim 1, wherein the cross-section of the shell of the sub-munitions is substantially circular and wherein the sub-munitions are arranged hexagonally.

4. Projectile according to claim 1, further comprising additional securing means arranged between the sub-munitions within each row.

5. Projectile according to the claim 4, wherein the additional securing means comprise a flexible material.

6. Projectile according to one of the claims 4, wherein the additional securing means comprise substantially cylindrical elements which are tangential to the shells of the sub-munitions.

7. Projectile according to claim 1, wherein the securing elements are made of a material capable of splitting up when said sub-munitions are ejected.

8. Projectile according to claim 1 further comprising a nose located at the front end of said external shell and ejected by said ejection means when said sub-munitions are ejected.

* * * * *